US011596283B2

(12) United States Patent
Thorne et al.

(10) Patent No.: US 11,596,283 B2
(45) Date of Patent: Mar. 7, 2023

(54) DRIVE SYSTEM FOR A SURFACE TREATMENT APPARATUS AND A SURFACE TREATMENT APPARATUS HAVING THE SAME

(71) Applicant: SharkNinja Operating, LLC, Needham, MA (US)

(72) Inventors: Jason B. Thorne, Dover, MA (US); Alden Kelsey, Newton Upper Falls, MA (US)

(73) Assignee: SharkNinja Operating LLC, Needham, MA (US)

( * ) Notice: Subject to any disclaimer, the term of this patent is extended or adjusted under 35 U.S.C. 154(b) by 145 days.

(21) Appl. No.: 16/881,582

(22) Filed: May 22, 2020

(65) Prior Publication Data

US 2020/0367711 A1 Nov. 26, 2020

Related U.S. Application Data

(60) Provisional application No. 62/851,811, filed on May 23, 2019.

(51) Int. Cl.
*A47L 9/04* (2006.01)
*A47L 5/30* (2006.01)

(52) U.S. Cl.
CPC ..... *A47L 9/0427* (2013.01); *A47L 5/30* (2013.01); *A47L 9/0411* (2013.01); *A47L 9/0477* (2013.01); *A47L 2201/06* (2013.01)

(58) Field of Classification Search
CPC ..... A47L 5/30; A47L 9/0427; A47L 9/0411; A47L 9/0477; A47L 9/04; A47L 9/0405; A47L 2201/06
USPC ..... 15/389, 390, 391, 392, 377, 383
See application file for complete search history.

(56) References Cited

U.S. PATENT DOCUMENTS 1,891,504 A * 12/1932 Smellie ..... A47L 5/34 15/384
2,102,645 A * 12/1937 Replogle ..... A47L 9/0411 15/377
3,150,394 A * 9/1964 Saners ..... A47L 11/4069 15/384
3,253,295 A 5/1966 Waters
4,426,751 A * 1/1984 Nordeen ..... A47L 9/0433 15/384
4,624,025 A * 11/1986 Kaulig ..... A47L 9/0488 15/384
4,654,927 A * 4/1987 Novinger ..... A47L 5/30 15/384

(Continued)

FOREIGN PATENT DOCUMENTS

KR 20150028448 A * 3/2015 ..... A47L 11/00
WO WO-2011077273 A1 * 6/2011 ..... A47L 11/282

OTHER PUBLICATIONS

WO-2011077273-A1 Espacenet original document in English (Year: 2022).*

(Continued)

*Primary Examiner* — Joseph J Hail
*Assistant Examiner* — Timothy Brady
(74) *Attorney, Agent, or Firm* — Grossman Tucker Perreault & Pfleger, PLLC

(57) ABSTRACT

A surface treatment apparatus may include a first agitator, a second agitator, and a drive system configured to cause the second agitator to rotate concurrently with the first agitator, the drive system including at least a first magnetic gear and a second magnetic gear.

18 Claims, 6 Drawing Sheets

(56) References Cited

U.S. PATENT DOCUMENTS 4,706,327 A 11/1987 Getz et al.
5,018,240 A * 5/1991 Holman ..... A47L 5/30 15/384
6,030,465 A * 2/2000 Marcussen ..... A47L 11/4041 15/384
6,073,303 A * 6/2000 Hinojosa ..... A47L 5/30 15/384
7,150,068 B1 * 12/2006 Ragner ..... A47L 9/0411 15/384
10,925,448 B2 * 2/2021 Thorne ..... A47L 9/0477
2002/0124334 A1 * 9/2002 Worwag ..... A47L 9/0494 15/384
2002/0124346 A1 * 9/2002 Steiner ..... A47L 9/04 15/384
2002/0129462 A1 * 9/2002 Matusz ..... A47L 9/0488 15/384
2003/0163888 A1 * 9/2003 Joo ..... A47L 9/0494 15/388
2003/0196294 A1 * 10/2003 Conrad ..... A01D 69/08 15/384
2005/0172447 A1 * 8/2005 Roney ..... A47L 9/0494 15/384
2006/0032013 A1 2/2006 Kim
2006/0191097 A1 * 8/2006 Baumhakel ..... A47L 11/4055 15/384
2008/0148512 A1 6/2008 Beskow et al.
2010/0037422 A1 2/2010 Behrenswerth
2016/0198924 A1 * 7/2016 Pruiett ..... B03C 1/12 15/104.8
2019/0204851 A1 * 7/2019 Afrouzi ..... A47L 9/2852

OTHER PUBLICATIONS

KR-20150028448-A Espacenet original document and translation (Year: 2022).*
PCT Search Report and Written Opinion dated Aug. 25, 2020, received in PCT Application No. PCT/US20/34272, 7 pgs.

* cited by examiner

DRIVE SYSTEM FOR A SURFACE TREATMENT APPARATUS AND A SURFACE TREATMENT APPARATUS HAVING THE SAME

CROSS-REFERENCE TO RELATED APPLICATIONS

The present application claims the benefit of U.S. Provisional Application Ser. No. 62/851,811 filed on May 23, 2019, entitled Surface Cleaning Head with Magnetic Gears, which is fully incorporated herein by reference.

TECHNICAL FIELD

The present disclosure is generally related to surface treatment devices and more specifically related to a drive system for one or more components of a surface treatment device.

BACKGROUND INFORMATION

Powered devices, such as vacuum cleaners, have multiple components that each receive electrical power from one or more power sources (e.g., one or more batteries or electrical mains). For example, a vacuum cleaner may include a suction motor, a debris collector, and a surface cleaning head. The suction motor is fluidly coupled to both the debris collector and the surface cleaning head such that the suction motor can cause a suction force to be generated at the surface cleaning head. The generated suction force urges debris deposited on a surface to be cleaned (e.g., a floor) into entrainment with air passing through the surface cleaning head such that the debris can be deposited in the debris collector. In some instances, the debris collector may be configured to generate one or more cyclones therein such that at least a portion of the entrained debris can be separated from the airflow through cyclonic action.

The surface cleaning head may include one or more agitators (e.g., brush rolls) configured to engage the surface to be cleaned. The engagement between the surface to be cleaned and the agitators may dislodge debris from the surface to be cleaned such that the dislodged debris may become entrained within air flowing into the surface cleaning head. In some instances, the surface cleaning head may include additional components (e.g., one or more lights to illuminate an area to be cleaned).

The one or more agitators may extend within a suction chamber defined within the surface cleaning head. The suction chamber defines a cavity having an open end through which at least a portion of the one or more agitators extends. A separation distance between the open end and the surface to be cleaned impacts a suction force generated by the suction motor at the open end. As the separation distance increases, a suction force decreases, which may reduce a quantity of debris entrained within air flowing through the surface cleaning head. As the separation distance decreases, the suction force increases. If the separation distance is decreased too much, the suction motor could be damaged.

In some instances, the surface cleaning head may include one or more of the debris collector and/or suction motor. In other instances, the debris collector and suction motor may be separate from the surface cleaning head. For example, an upright section (e.g., a wand) may be pivotally coupled to the surface cleaning head and the suction motor and debris collector may be coupled to the upright section. By way of further example, the vacuum cleaner may include a moveable canister fluidly coupled to the surface cleaning head, wherein a flexible hose extends between the moveable canister and the surface cleaning head. The moveable canister can include the suction motor and the debris collector.

BRIEF DESCRIPTION OF THE DRAWINGS

These and other features and advantages will be better understood by reading the following detailed description, taken together with the drawings, wherein.

DETAILED DESCRIPTION

The present disclosure is generally directed to a surface treatment apparatus. The surface treatment apparatus includes a surface cleaning head having a first agitator and a second agitator, a rotation of the first agitator causing a corresponding rotation in the second agitator. A drive system is configured to transfer rotational movement from the first agitator to the second agitator such that the first and second agitators rotate concurrently. The drive system includes at least a first ring of magnets and a second ring of magnets, each configured to be rotated in response to the rotation of the first agitator. The magnets are arranged according to polarity in an alternating fashion. The first and second magnet rings may be oriented such that magnetic fields generated by the magnets of each ring interact to cause the first and second magnet rings to rotate together. As such, the first and second magnet rings may generally be described as magnetic gears, wherein the magnetic fields define the cogs (or teeth) of the magnetic gears.

Figure 1:
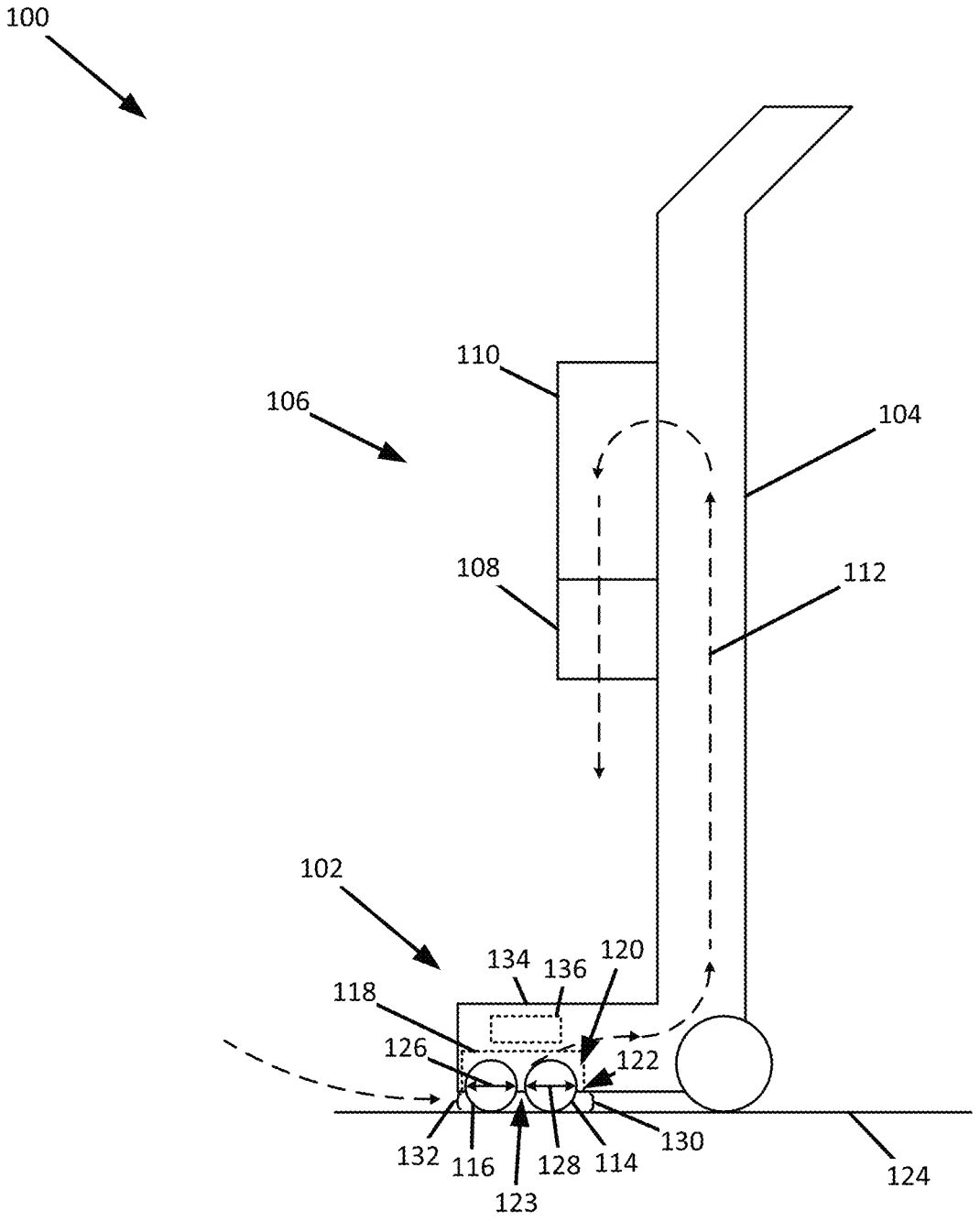
FIG. 1 shows a schematic example of a surface treatment apparatus, consistent with embodiments of the present disclosure.

FIG. 1 shows a schematic example of a surface treatment apparatus 100. As shown, the surface treatment apparatus 100 includes a surface cleaning head 102, an upright section 104 pivotally coupled to the surface cleaning head 102, and a vacuum assembly 106 coupled to the upright section 104. The vacuum assembly 106 includes a suction motor 108 and a debris collector 110. The suction motor 108 is configured to cause air to flow along an airflow path 112 that extends from the surface cleaning head 102, into the debris collector 110, and through the suction motor 108. In other words, the suction motor 108 is fluidly coupled to both the debris collector 110 and the surface cleaning head 102.

The surface cleaning head 102 includes a first agitator 114 and a second agitator 116. The first and second agitators 114 and 116 extend within a suction chamber 118 of the surface cleaning head 102. As shown, the suction chamber 118 defines a cavity 120 having at least one open end 122, wherein at least a portion of the first and second agitator 114 and 116 extend from the open end 122 and engage a surface to be cleaned 124 (e.g., a floor). The first and second agitator 114 and 116 can be configured to rotate concurrently at the same or different rotational speeds and in the same or different rotational directions. The rotation of the first and second agitators may cause at least a portion of debris adhered to the surface to be cleaned 124 to be dislodged therefrom. The dislodged debris may become entrained within air flow along the airflow path 112. For example, the first and second agitators 114 and 122 can be configured to be counter rotating such that dislodged debris is urged towards a central portion of the open end 122. In some instances, the airflow path 112 can extend through an inter-agitator passageway 123 defined between the first and second agitators 114 and 116. At least a portion of one or more of the first and/or second agitators 114 and/or 116 may be substantially isolated from the airflow path 112 such air flowing along the airflow path 112 is not incident on the isolated portion of the first and/or second agitators 114 and/or 116.

The first and second agitators 114 and 116 may include one or more cleaning elements such as bristles (e.g., bristle tufts or bristle strips), fabrics, and/or continuous flexible flaps extending along a body thereof. The cleaning elements may be arranged according to a pattern (e.g., a spiral or chevron pattern). The first and second agitators 114 and 116 may have the same or different construction. For example, the one or more cleaning elements of the first agitator 114 may be stiffer (less flexible) than the one or more cleaning elements of the second agitator 116. In some instances, one or more of the first and/or second agitators 114 and/or 116 may be removable from the surface cleaning head 102 (e.g., for cleaning or replacement). For example, the first and/or second agitators 114 and/or 116 may be removable from the surface cleaning head 102 through an openable door.

In some instances, at least a portion of the second agitator 116 can be the forward most portion of the surface cleaning head 102. In these instances, the second agitator 116 can engage a surface (e.g., a wall) that extends from the surface to be cleaned 124. Additionally, or alternatively, the cleaning elements of the second agitator 116 may be configured such that at least a partial seal is formed between the second agitator 116 and the surface to be cleaned 124. Such a configuration may increase a suction force at the open end 122 by reducing an area through which air may enter the open end 122.

A second agitator diameter 126 may measure differently from (e.g., less than) a first agitator diameter 128. When the second agitator 116 is the forward most portion of the surface cleaning head 102, such a configuration may improve cleaning performance adjacent a wall. Further, such a configuration, may reduce an overall size of a forward portion of the surface cleaning head 102, which may allow at least the forward portion of the surface cleaning head 102 to extend under an obstacle (e.g., a piece of furniture). A ratio of the second agitator diameter 126 to the first agitator diameter 128 (i.e., the second agitator diameter 126 divided by the first agitator diameter 128) may be in a range of, for example, ¼ to 1/1. By way of further example, the ratio of the second agitator diameter 126 to the first agitator diameter 128 may be ½. By way of still further example, the ratio of the second agitator diameter 126 to the first agitator diameter 128 may be ¾. In some instances, the second agitator diameter 126 may measure the same as the first agitator diameter 128.

A first agitator extension distance 130 and a second agitator extension distance 132 may measure the same or different. The first agitator extension distance 130 corresponds to a portion of the first agitator 114 extending from the open end 122 towards the surface to be cleaned 124 (or a direction away from the surface clean head 102) and the second agitator extension distance 132 corresponds to a portion of the second agitator 116 extending from the open end 122 towards the surface to be cleaned 124 (or a direction away from the surface clean head 102). The first and second agitator extension distances 130 and 132 correspond to the extension distance of the first and second agitators 114 and 116 in a non-compressed state. The second agitator extension distance 132 may measure, for example, greater than the first agitator extension distance 130. In this example, when engaging the surface to be cleaned 124, the cleaning elements of the second agitator 116 may be compressed to a greater extent than the cleaning elements of the first agitator 114. By way of further example, the first agitator extension distance 130 may measure greater than the second agitator extension distance 132. In this example, when engaging the surface to be cleaned 124, the cleaning elements of the first agitator 114 may be compressed to a greater extent than the cleaning elements of the second agitator 116. Additionally, or alternatively, one or more of the first and/or second agitators 114 and 116 may be configured to float relative to a body 134 of the surface cleaning head 102. For example, the first agitator 114 (or the second agitator 116) can be configured to move in response to changes in the surface to be cleaned 124 such that the first agitator extension distance 130 (or second agitator extension distance 132) changes.

As shown, the surface cleaning head 102 includes a drive system 136 configured to cause the first and second agitators 114 and 116 to rotate concurrently. The drive system 136 is configured to couple the first agitator 114 to the second agitator 116 such that a rotation of the first agitator 114 causes a corresponding rotation of the second agitator 116. The drive system 136 can be configured such that the first and second agitators 114 and 116 rotate at the same or different speeds. The drive system 136 can be further configured such that the first and second agitators 114 and 116 rotate in the same or different directions. For example, the drive system 136 can be configured such that the first and second agitators 114 and 116 are counter rotating such that dislodged debris is urged towards a central portion of the open end 122. By way of further example, the drive system 136 can be configured such that the first and second agitator 114 and 116 rotate in the same (or a common) direction (e.g., such that debris is urged towards a rearward portion of the surface cleaning head 102).

While FIG. 1 generally illustrates an upright surface treatment apparatus having the drive system 136. Other surface treatment apparatuses may utilize the drive system 136. For example, robotic vacuum cleaners, canister vacuum cleaners, handheld vacuum cleaners, central vacuum cleaners, upright surface treatment apparatuses having a configurations different from that shown in FIG. 1 (e.g., at least a portion of the vacuum assembly 106 may be included in the surface cleaning head 102), and/or any other surface treatment apparatus. In instances where the vacuum assembly is included in the surface cleaning head 102, the surface cleaning head 102 may be operated independent from the upright section 104.

Figure 2:
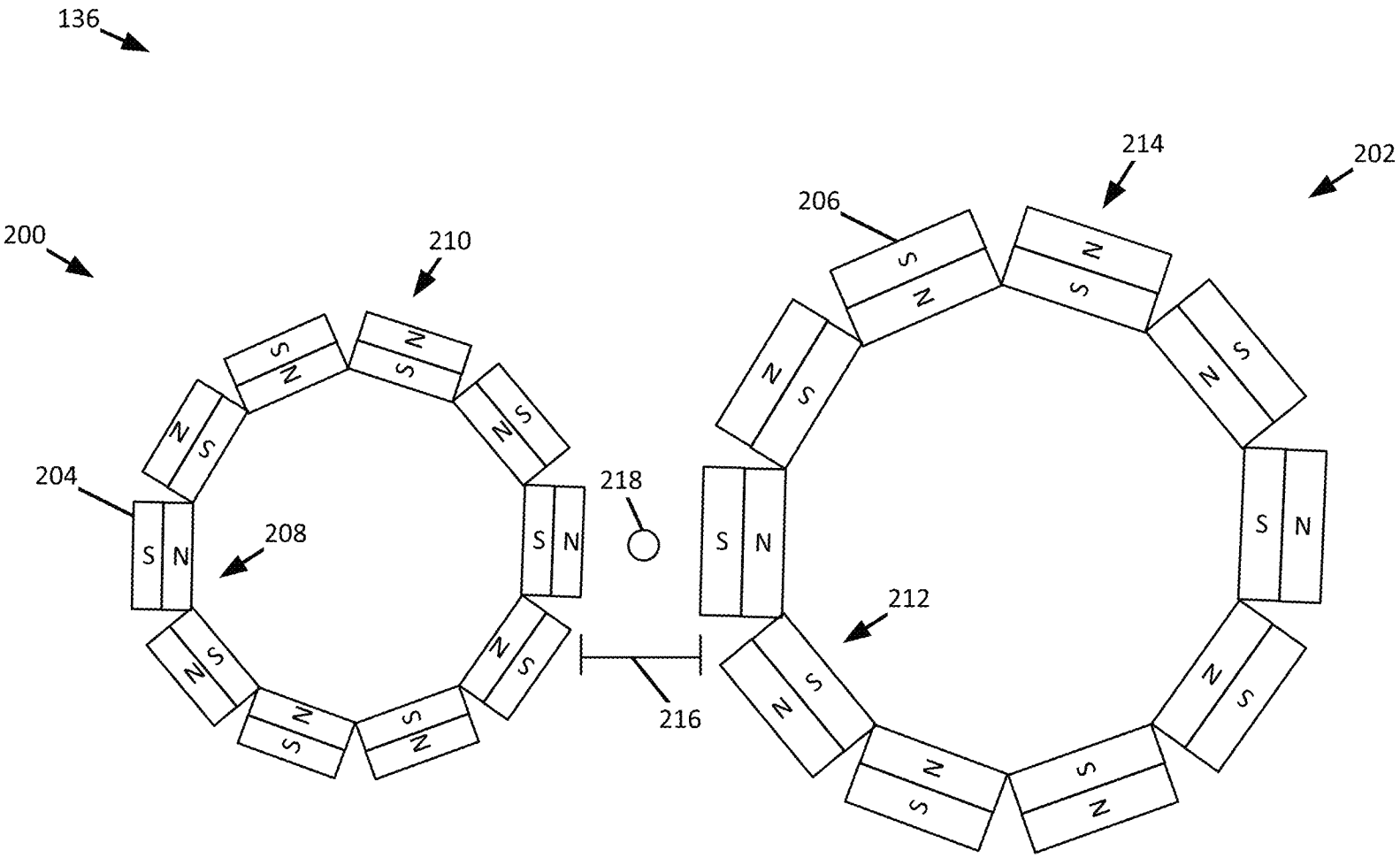
FIG. 2 shows a schematic example of a drive system capable of being used with the surface treatment apparatus of FIG. 1, consistent with embodiments of the present disclosure.

FIG. 2 shows a schematic example of the drive system 136 of FIG. 1. As shown, the drive system 136 includes a first magnet ring 200 and a second magnet ring 202. The first magnet ring 200 includes a first set of magnets 204 arranged in a ring shape and the second magnet ring 202 includes second set of magnets 206 arranged in a ring shape. The first magnet ring 200 defines a first ring inner perimeter 208 and a first ring outer perimeter 210. The second magnet ring 202 defines a second ring inner perimeter 212 and a second ring outer perimeter 214.

The first set of magnets 204 are arranged according to polarity. For example, the first set of magnets 204 may be arranged such that a polarity between immediately adjacent magnets alternates along the first ring inner perimeter 208 and the first ring outer perimeter 210. In other words, the first ring inner perimeter 208 and the first ring outer perimeter 210 are defined by the north and south poles of the first set of magnets 204, wherein each north pole is immediately adjacent a south pole of another magnet of the first set of magnets 204. As such, the first ring inner perimeter 208 may generally be described as having a polarity that alternates along the first ring inner perimeter 208 and the first ring outer perimeter 210 may generally be described as having a polarity that alternates along the first ring outer perimeter 210.

The second set of magnets 206 are also arranged according to polarity. For example, the second set of magnets 206 may be arranged such that a polarity between immediately adjacent magnets alternates along the second ring inner perimeter 212 and the second ring outer perimeter 214. In other words, the second ring inner perimeter 212 and the second ring outer perimeter 214 are defined by the north and south poles of the second set of magnets 206, wherein each north pole is immediately adjacent a south pole of another magnet of the second set of magnets 206. As such, the second ring inner perimeter 212 may generally be described as having a polarity that alternates along the second ring inner perimeter 212 and the second ring outer perimeter 214 may generally be described as having a polarity that alternates along the second ring outer perimeter 214.

As shown, the first magnet ring 200 may be oriented relative to the second magnet ring 202 such that magnetic fields of the first set of magnets 204 interact with magnetic fields of the second set of magnets 206. For example, at a location where a separation distance 216 between the first ring outer perimeter 210 and the second ring outer perimeter 214 is minimized a polarity of the first ring outer perimeter 210 may be opposite the polarity of the second ring outer perimeter 214. In other words, at the location where the separation distance 216 is minimized, one of a north pole or a south pole of a magnet of the first set of magnets 204 faces the other of a north pole or a south pole of a magnet of the second set of magnets 206.

As such, the first magnet ring 200 may generally be described a first magnetic gear, wherein the magnetic fields generated by each of the magnets of the first set of magnets 204 may generally be described as defining the cogs (or teeth) of the first magnetic gear. Further, the second magnet ring 202 may generally be described as a second magnetic gear, wherein the magnetic fields generated by each of the magnets of the second set of magnets 206 may generally be described as defining the cogs (or teeth) of the second magnetic gear. In operation, the magnetic fields of the first and second magnetic gears interact such that a rotation in one magnetic gear causes a corresponding rotation in the other magnetic gear.

In some instances, the drive system 136 may include a temporary magnet 218 that may be positioned between the first and second magnet rings 200 and 202. The temporary magnet 218 can be positioned between the first and second magnet rings 200 and 202 such that the temporary magnet 218 interacts with the magnetic fields generated by the first and second sets of magnets 204 and 206. For example, the temporary magnet 218 may be positioned between the first and second magnet rings 200 and 202 proximate to the location where the separation distance 216 is minimized. By way of further example, a central axis (e.g., a central longitudinal axis) of the temporary magnet 218 may be spaced apart from the first ring outer perimeter 210 by a distance measuring half of the minimum separation distance 216 and may be spaced apart from the second ring outer perimeter 214 by a distance measuring half of the minimum separation distance 216. The temporary magnet 218 may be configured to orient and/or control a direction of rotation of the first and second magnet rings 200 and 202. For example, the temporary magnet 218 may cause the first and second magnet rings 200 and 202 to rotate in the same direction. The temporary magnet 218 may be an iron rod or pin that extends between the first and second magnet rings 200 and 202.

Figure 3:
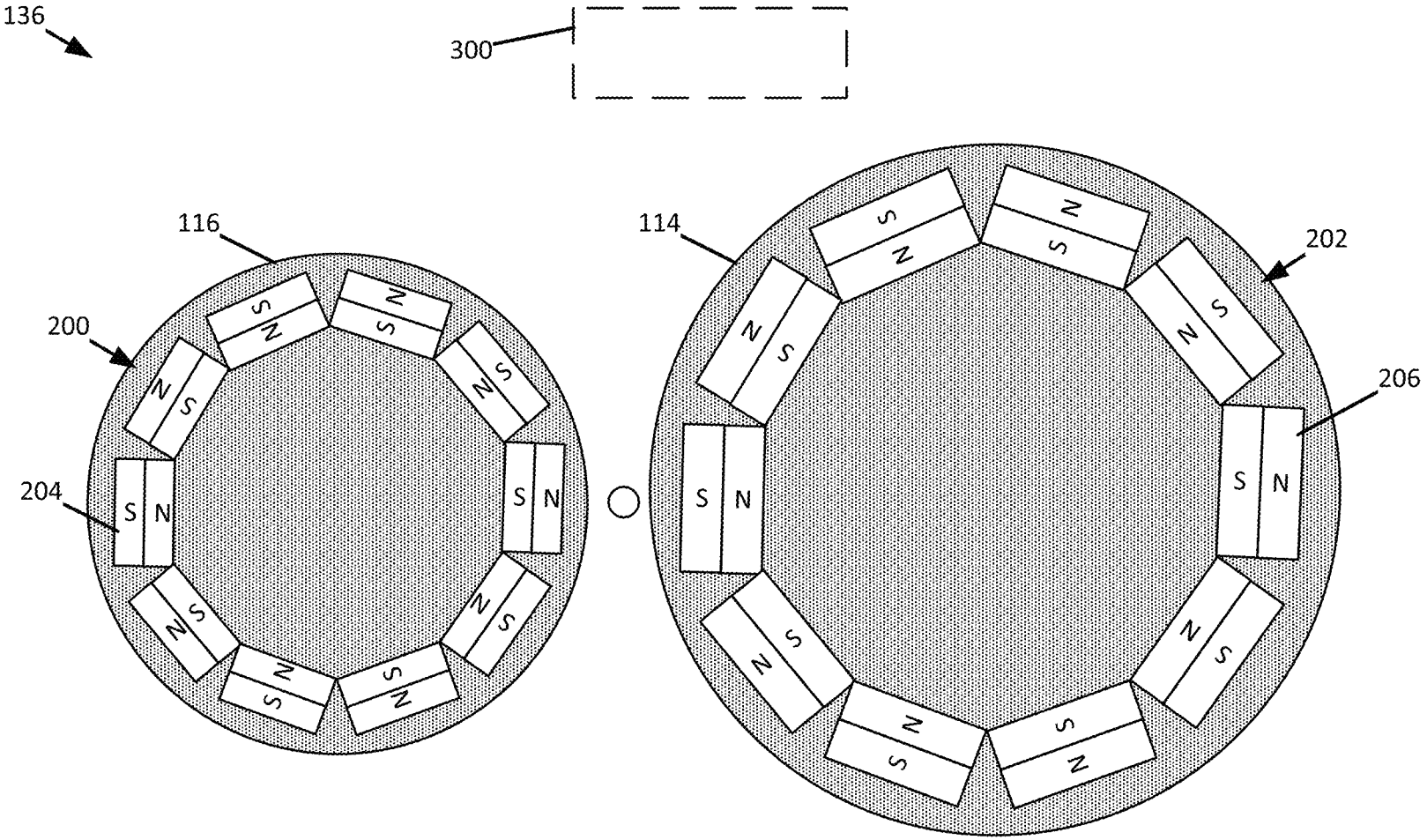
FIG. 3 shows a schematic example of the drive system of FIG. 2 coupled to corresponding agitators, consistent with embodiments of the present disclosure.

FIG. 3 shows a schematic example of the drive system 136 coupled to the first and second agitators 114 and 116. As shown, the first set of magnets 204 of the first magnet ring 200 is coupled to the second agitator 116 and the second set of magnets 206 of the second magnet ring 202 is coupled to the first agitator 114. As such, the first and second magnet rings 200 and 202 rotate together with the first and second agitators 114 and 116. For example, when an agitator drive motor 300 causes the first agitator 114 to rotate, the second magnet ring 202 rotates with the first agitator 114. Rotation of the second magnet ring 202 causes a corresponding rotation in the first magnet ring 200 as a result of the interaction between the magnet fields of the first and second sets of magnets 204 and 206. A rotation of the first magnet ring 200 causes a corresponding rotation in the second agitator 116. As such, the drive system 136 can generally be described as being configured to transfer a rotational motion of the first agitator 114 to the second agitator 116 through the use of one or more magnetic gears.

In some instances, the agitator drive motor 300 may be included within the first agitator 114 and configured to cause the first agitator 114 to rotate. In other instances, the agitator drive motor 300 may be external to the first agitator 114 and configured to cause the first agitator 114 to rotate. For example, the agitator drive motor 300 may be configured to cause the first agitator 114 to rotate using one or more belts and/or traditional gears (gears relying on physical inter-engagement). By way of further example, the agitator drive motor 300 may be configured to cause the first agitator 114 to rotate using one or more magnetic gears.

Figure 4:
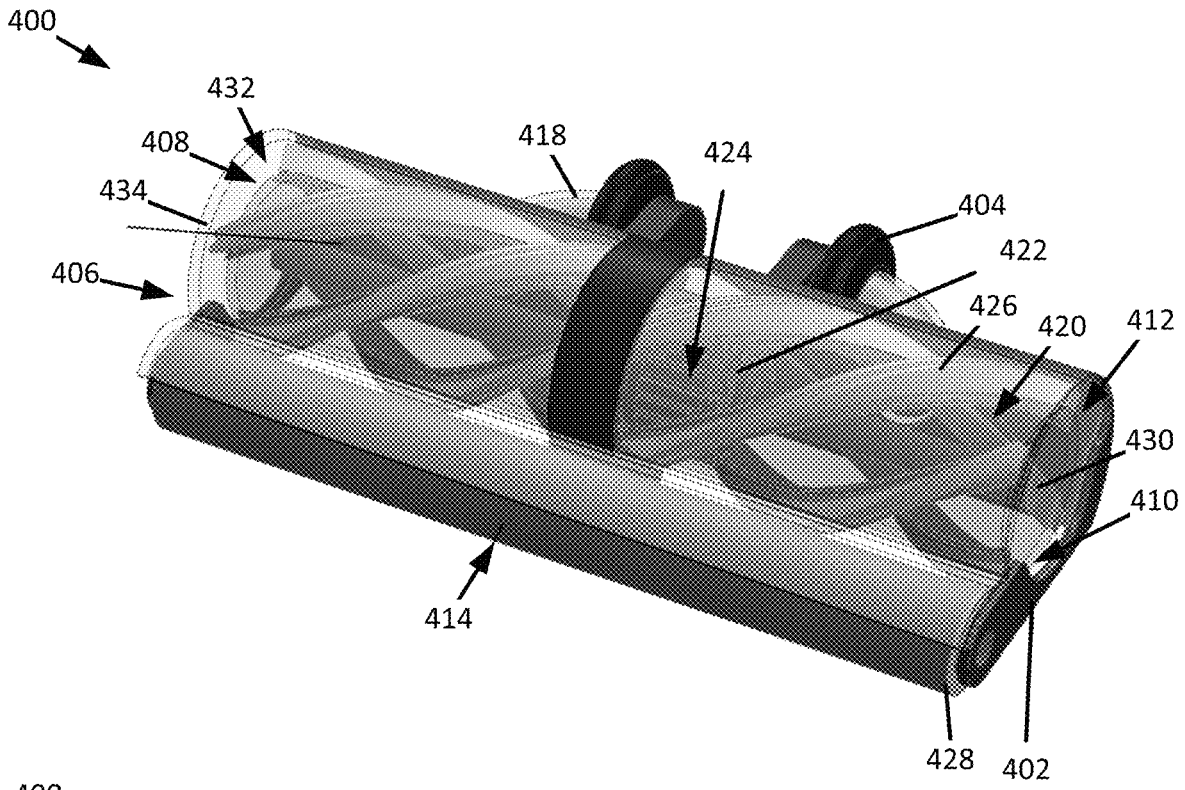
FIG. 4 shows a perspective view of a surface cleaning head, consistent with embodiments of the present disclosure.
Figure 5:
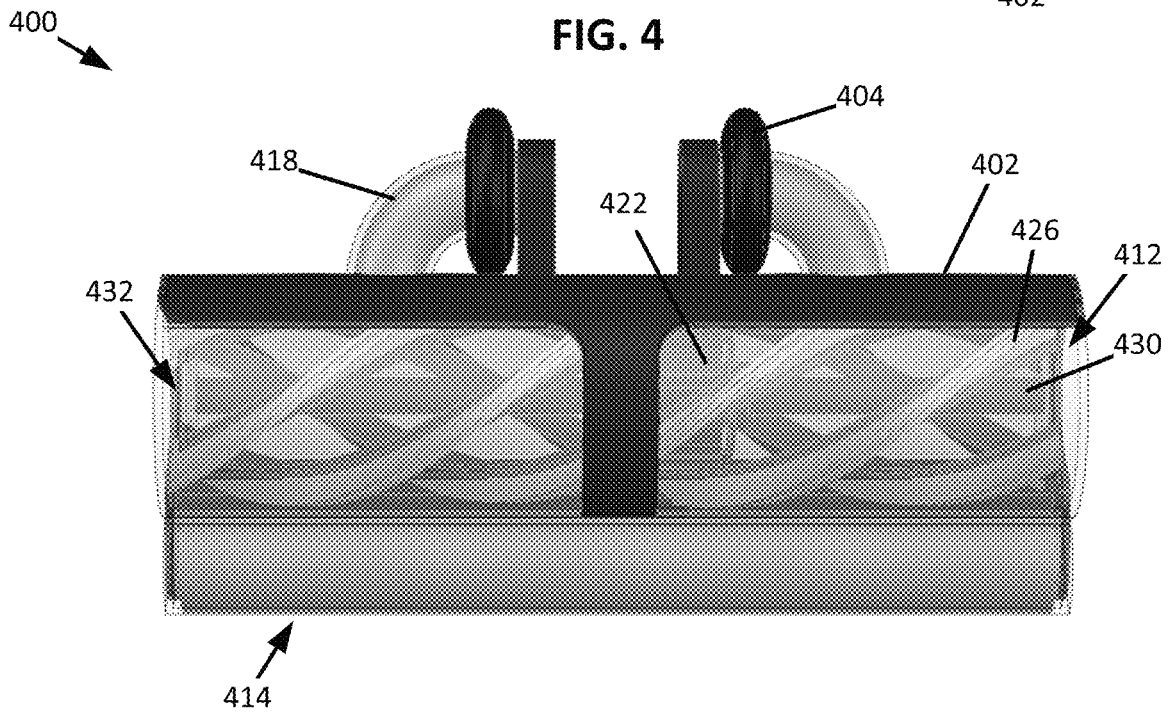
FIG. 5 shows a top view of the surface cleaning head of FIG. 4, consistent with embodiments of the present disclosure.

FIG. 4 shows a perspective view of a surface cleaning head 400, which may be an example of the surface cleaning head 102 of FIG. 1, and FIG. 5 shows a top view of the surface cleaning head 400. As shown, the surface cleaning head 400 includes a body 402, one or more wheels 404 rotatably coupled to the body 402, an agitator chamber 406 that defines a cavity 408 having an open end 410, the cavity 408 being defined within the body 402, a first and second agitator 412 and 414 are rotatably coupled to the body 402 and extend within the agitator chamber 406 such that at least a portion of the first and second agitators 412 and 414 protrude from the open end 410 in a direction away from the agitator chamber 406 (e.g., towards a surface to be cleaned such as a floor). In some instances, the second agitator 414 may extend from the cavity 408 such that the second agitator 414 defines a forward most portion of the surface cleaning head 400. The surface cleaning head 400 may further include a fluid pathway 418 that is fluidly coupled to the agitator chamber 406. In operation, a suction motor (e.g., the suction motor 108 of FIG. 1) is configured to cause air to be drawn from the agitator chamber 406 and into the fluid pathway 418. As shown, the surface cleaning head 400 may include a plurality of wheels 404 and a plurality of fluid pathways 418, wherein a respective fluid pathway 418 extends through a respective wheel 404. As such, in some instances, the plurality of wheels 404 can be configured to be rotatably coupled to a respective fluid pathway 418.

The first and second agitators 412 and 414 are configured to rotate together at the same or different speeds and in the same or different directions. As shown, the first agitator 412 includes a motor chamber 420. An agitator motor 422 is disposed within the motor chamber 420 and configured to cause the first agitator 412 to rotate. The agitator motor 422 may have, for example, a power rating in a range of 75 watts (W) to 125 W. By way of further example, the agitator motor 422 may have a power rating of 100 W.

The rotational movement of the first agitator 412 may be transferred to the second agitator 414 using a drive system 424 (which may be an example of the drive system 136 of FIG. 1). The drive system 424 may include at least two magnetic gears configured to cooperate to cause the second agitator 414 to rotate concurrently with the first agitator 412.

The first and second agitators 412 and 414 may include one or more cleaning elements 426 and 428 (e.g., bristles, such as nylon or carbon bristles, continuous flexible strips, such as rubber or fabric flaps, and/or any other cleaning element). The cleaning elements 426 and 428 may be arranged around the first and second agitators 412 and 414 according to the same or different pattern. For example, the cleaning elements 426 of the first agitator 412 may be arranged according to a spiral pattern and the cleaning elements 428 of the second agitator 414 may be arranged in a filled pattern (e.g., a core of the second agitator 414 is substantially obscured by the cleaning elements 428).

The cleaning elements 426 of the first agitator 412 may be the same or different from the cleaning elements 428 of the second agitator 414. In some instances, the cleaning elements 426 and 428 may have a shape and/or material that encourages a specific cleaning behavior (e.g., hair migration, improved hard/soft floor cleaning, and/or any other cleaning behavior). For example, the cleaning elements 428 of the second agitator 414 may be softer (e.g., more flexible) than the cleaning elements 426 of the first agitator 412.

In some instances, the first agitator 412 may include at least two different cleaning elements 426. For example, a first cleaning element 426 may be stiffer than a second cleaning element 426. In this example, the first cleaning element 426 may be, for example, nylon or carbon bristles having a diameter of 0.23 millimeters (mm)+/−0.02 mm and the second element 426 may be softer bristles (e.g., having a diameter of less than 0.23 mm) or flexible strips of a continuous material. By way of further example, the first cleaning element 426 may be a first flexible strip (e.g., of bristles or a continuous material) arranged around the first agitator 412 according to a spiral pattern and the second cleaning element 426 may be a second flexible strip arranged around the first agitator 412 according to a spiral pattern, wherein the second flexible strip has a rigidity that is different from that of the first flexible strip. In some instances, the dimensions of the first flexible strip (e.g., a width or height) may be different from the dimension of the second flexible strip. For example, when the first flexible strip is wider than the second flexible strip, the first flexible strip may be configured to be less rigid than the second flexible strip.

Similarly, the second agitator 414 may include at least two different cleaning elements 428. For example, a first cleaning element 428 may be stiffer than a second cleaning element 428. In this example, the first cleaning element 428 may be, for example, nylon or carbon bristles having a diameter of 0.23 millimeters (mm)+/−0.02 mm and the second element 428 may be softer bristles (e.g., having a diameter of less than 0.23 mm) or flexible strips of a continuous material. By way of further example, the first cleaning element 428 may be a first flexible strip (e.g., of bristles or a continuous material) arranged around the second agitator 414 according to a spiral pattern and the second cleaning element 428 may be a second flexible strip arranged around the second agitator 414 according to a spiral pattern, wherein the second flexible strip has a rigidity that is different from that of the first flexible strip. In some instances, the dimensions of the first flexible strip (e.g., a width or height) may be different from the dimension of the second flexible strip. For example, when the first flexible strip is wider than the second flexible strip, the first flexible strip may be less rigid than the second flexible strip.

As shown, the first agitator 412 includes a bar 430 that extends through the motor chamber 420. The bar 430 can be configured to couple to the body 402 of the surface cleaning head 400. For example, the bar 430 can be coupled to the body 402 such that the first agitator 412 is cantilevered within the agitator chamber 406. Cantilevering the first agitator 412 within the agitator chamber 406 may result in a gap 432 being formed between a distal end of the first agitator 412 and a sidewall 434 of the agitator chamber 406 that extends transverse to the first agitator 412. The first agitator 412 can be configured such that, in operation, fibrous debris (e.g., hair or string) is migrated along the first agitator 412 towards the gap 432. Upon reaching the gap 432, the fibrous debris may fall off the first agitator 412 and become entrained within air flowing through the surface cleaning head 400.

Figure 6:
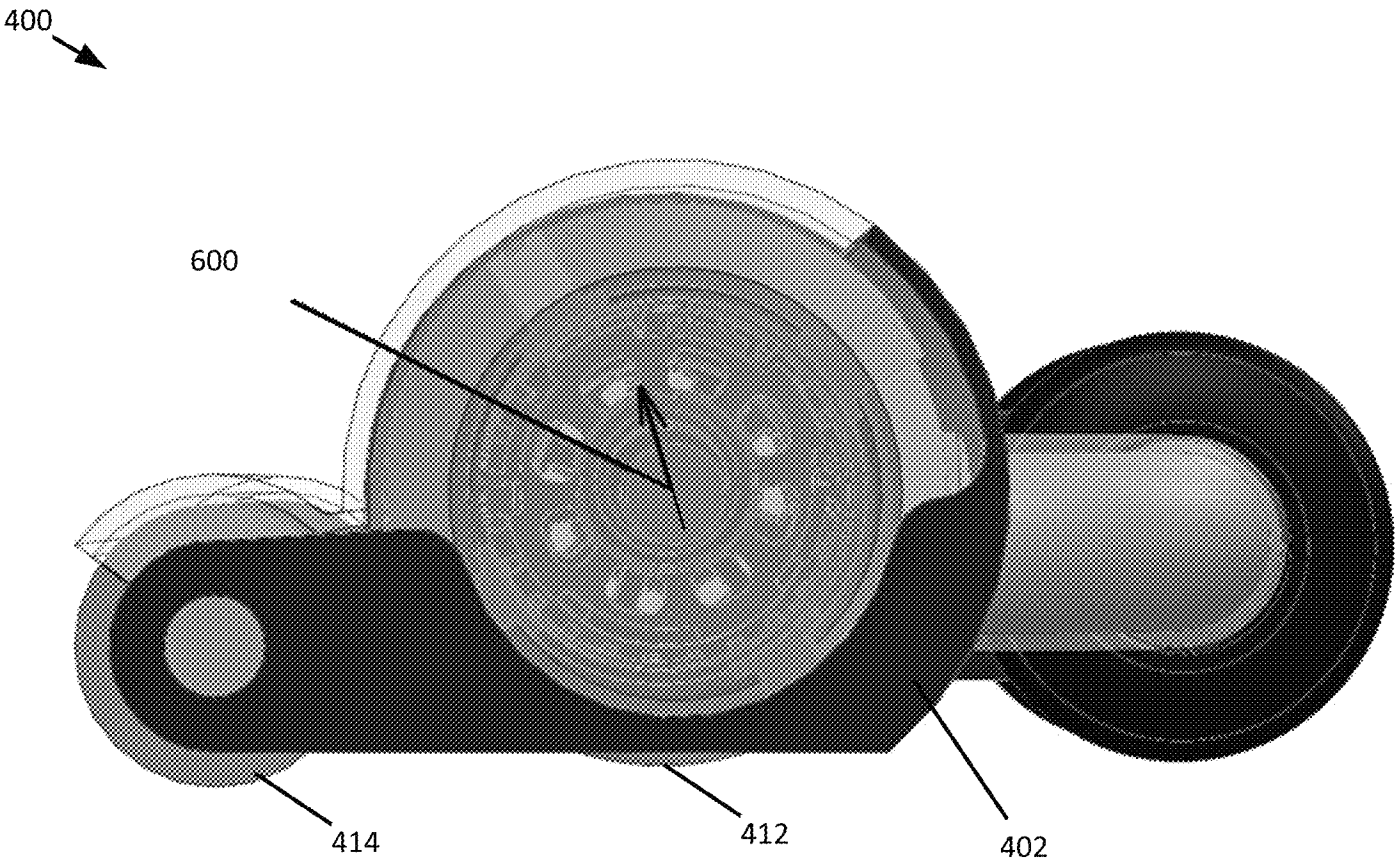
FIG. 6 shows a side view of the surface cleaning head of FIG. 4, consistent with embodiments of the present disclosure.

FIG. 6 shows a side view of the surface cleaning head 400 of FIG. 4. The first agitator 412 can be configured to float relative to the body 402. In other words, the first agitator 412 may be configured to move along one or more axes (e.g., a vertical and/or horizontal axis). For example, the first agitator 412 may be configured to move along an axis 600 (e.g., an axis having both vertical and horizontal components). In some instances, movement of the first agitator 412 along one or more axes may be caused by variations in a surface to be cleaned (e.g., a presence of a threshold extending between two different surface types such as hard floor and carpet). The first agitator 412 can be biased such that it is urged in a direction of the surface to be cleaned such that a consistent engagement between the first agitator 412 and the surface to be cleaned can be maintained. Additionally, or alternatively, the first agitator 412 can be configured to move towards or away from a surface to be cleaned based, at least in part, on a surface type (e.g., carpet or hard floor). For example, the first agitator 412 can be configured to be moved away from a hardwood floor (e.g., to prevent damage, such as scratches, to the hardwood floor caused by cleaning elements of the first agitator 412) and to be moved toward a carpet (e.g., to increase engagement between the cleaning elements of the first agitator 412 and the carpet).

The second agitator 414 may additionally, or alternatively, be configured to float relative to the body 402 in a manner similar to that of the first agitator 412. As such, at least one of the first and/or second agitators 412 and/or 414 may be configured to float relative to the body. Additionally, or alternatively, the second agitator 414 may be configured to move towards or away from a surface to be cleaned based, at least in part, on surface type in a manner similar to that of the first agitator 412. As such, at least one of the first and/or second agitators 412 and/or 414 may be configured to move towards or away from a surface to be cleaned based, at least in part, on surface type.

In some instances, one or more of the first and/or second agitators 412 and/or 414 can be configured to move towards and away from the surface to be cleaned independently of each other. For example, the first agitator 412 can be configured to float relative to the body 402 independent of the second agitator 414. In some instances, the movement of the first agitator 412 (or second agitator 414) relative to the second agitator 414 (or first agitator 412) may be configured such that the magnetic gears of the drive system 424 continue to cooperate to transfer rotational motion from the first agitator 412 to the second agitator 414. For example, the first agitator 412 may be configured to move along a path configured to maintain an orientation between magnetic gears of the drive system 424 that allows the transfer of rotational motion from the first agitator 412 to the second agitator 414. In other words, the drive system 424 allows for a plurality of agitators (e.g., the first and second agitators 412 and 414) to be driven by a single agitator drive motor (e.g., the agitator motor 422) while still being able to move independently of each other based on variations in the surface to be cleaned.

Figure 7:
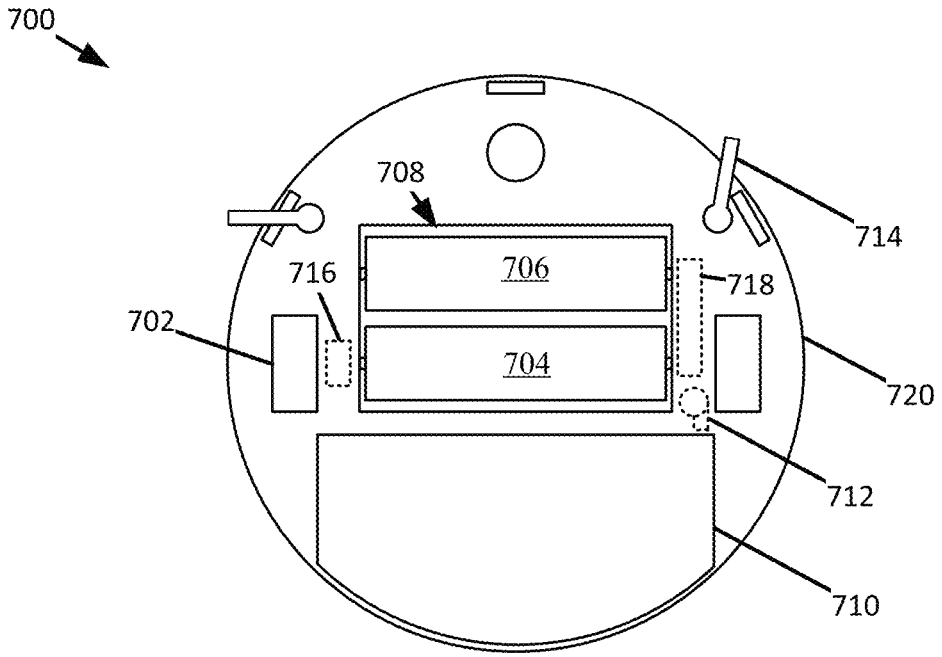
FIG. 7 shows a schematic example of a robotic surface treatment apparatus, consistent with embodiments of the present disclosure.

FIG. 7 shows a schematic bottom view of a robotic surface treatment apparatus 700. As shown, the robotic surface treatment apparatus 700 includes at least one driven wheel 702 configured to urge the robotic surface treatment apparatus 700 across a surface to be cleaned, a first and second agitator 704 and 706 disposed within an agitator chamber 708, a debris collector 710 fluidly coupled to the agitator chamber 708, and a suction motor 712 fluidly coupled to the debris collector 710 and configured to urge air to flow into the agitator chamber 708. The robotic surface treatment apparatus 700 may include one or more side brushes 714 configured to urge debris towards the first and second agitators 704 and 706. The first agitator 704 may be coupled to an agitator motor 716 such that the agitator motor 716 causes the first agitator 704 to rotate. A drive system 718 (which may be an example of the drive system 136) transfers rotational motion from the first agitator 704 to the second agitator 706 such that the first and second agitators 704 and 706 rotate concurrently. The drive system 718 includes a plurality of magnetic gears configured to cooperate to cause the first and second agitators 704 and 706 to rotate concurrently. The first and second agitators 704 and 706 may rotate at the same or different speeds and/or rotate in the same or different directions.

Use of magnetic gears in the drive system 718 may result in the drive system being more compact compared to a drive system using belts and/or traditional gears. This may maximize the space available within the robotic surface treatment apparatus 700 for other components (e.g., one or more batteries, motors, and/or any other component). In some instances, the drive system 718 may be configured to cause both the first and second agitators 704 and 706 to rotate in the same direction (e.g., through use of a temporary magnet disposed between at least two magnetic gears). For example, the first and second agitator 704 and 706 may be configured to rotate in a direction that corresponds to a rotational direction of the at least when driven wheel 702 when the robotic surface treatment apparatus 700 is moving in a forward direction. Such a configuration may result in the rotation of the first and second agitators 704 and 706 encouraging forward movement of the robotic surface treatment apparatus 700, which may reduce an amount energy consumed by the at least one driven wheel 702. In some instances, the first and/or second agitators 704 and/or 706 may be configured to move towards or away from a surface to be cleaned. For example, the first and/or second agitators 704 and/or 706 may be configured to float relative to a body 720 of the robotic surface treatment apparatus 700.

An example of a surface treatment apparatus, consistent with the present disclosure, may include a first agitator, a second agitator, and a drive system configured to cause the second agitator to rotate concurrently with the first agitator, the drive system including at least a first magnetic gear and a second magnetic gear.

In some instances, the surface treatment apparatus may further include an agitator motor configured to cause the first agitator to rotate. In some instances, the drive system may be configured to cause the first and second agitator to rotate at different speeds. In some instances, the drive system may be configured to cause the first and second agitator to rotate in a common direction. In some instances, the surface treatment apparatus may further include a body, the first agitator and the second agitator being rotatably coupled to the body and at least one of the first agitator or the second agitator is configured to float relative to the body. In some instances, the first agitator may be configured to float relative to the body independent of the second agitator. In some instances, the drive system further may further include a temporary magnet disposed between the first magnetic gear and the second magnetic gear. In some instances, the temporary magnet may be an iron pin. In some instances, a diameter of the first agitator may measure differently from a diameter of the second agitator. In some instances, the first magnetic gear may be coupled to the first agitator and the second magnetic gear may be coupled to the second agitator.

Another example of a surface treatment apparatus, consistent with the present disclosure, may include an upright section and a surface treatment head. The upright section may be pivotally coupled to the surface treatment head. The surface treatment head may include a first agitator, a second agitator, and a drive system having a first magnetic gear coupled to the first agitator and a second magnetic gear coupled to the second agitator, a rotation of the first magnetic gear causing a corresponding rotation of the second magnetic gear.

In some instances, the surface treatment apparatus may further include an agitator motor configured to cause the first agitator to rotate. In some instances, the drive system may be configured to cause the first and second agitator to rotate at different speeds. In some instances, the drive system may be configured to cause the first and second agitator to rotate in a common direction. In some instances, the surface treatment apparatus may further include a body, the first agitator and the second agitator being rotatably coupled to the body and at least one of the first agitator or the second agitator is configured to float relative to the body. In some instances, the first agitator may be configured to float relative to the body independent of the second agitator. In some instances, the drive system may further include a temporary magnet disposed between the first magnetic gear and the second magnetic gear. In some instances, the temporary magnet may be an iron pin. In some instances, a diameter of the first agitator may measure differently from a diameter of the second agitator. In some instances, the first agitator may be cantilevered.

An example of a robotic surface treatment apparatus, consistent with the present disclosure, may include at least one driven wheel, a debris collector, a first agitator, a second agitator, and a drive system configured to cause the second agitator to rotate concurrently with the first agitator, the drive system including at least a first magnetic gear and a second magnetic gear.

In some instances, the robotic surface treatment apparatus may further include an agitator motor configured to cause the first agitator to rotate. In some instances, the drive system may be configured to cause the first and second agitator to rotate at different speeds. In some instances, the drive system may be configured to cause the first and second agitator to rotate in a common direction. In some instances, the robotic surface treatment apparatus may further include a body, the first agitator and the second agitator being rotatably coupled to the body and at least one of the first agitator or the second agitator is configured to float relative to the body. In some instances, the first agitator may be configured to float relative to the body independent of the second agitator. In some instances, the drive system further may further include a temporary magnet disposed between the first magnetic gear and the second magnetic gear. In some instances, the temporary magnet may be an iron pin. In some instances, a diameter of the first agitator may measure differently from a diameter of the second agitator. In some instances, the first magnetic gear may be coupled to the first agitator and the second magnetic gear may be coupled to the second agitator.

While the principles of the invention have been described herein, it is to be understood by those skilled in the art that this description is made only by way of example and not as a limitation as to the scope of the invention. Other embodiments are contemplated within the scope of the present invention in addition to the exemplary embodiments shown and described herein. Modifications and substitutions by one of ordinary skill in the art are considered to be within the scope of the present invention, which is not to be limited except by the following claims.

What is claimed is:

1. A surface treatment apparatus comprising:
- a first agitator;
- a second agitator; and
- a drive system configured to cause the second agitator to rotate concurrently with the first agitator, the drive system including:
  - at least a first magnetic gear and a second magnetic gear; and
  - a temporary magnet disposed between the first magnetic gear and the second magnetic gear.

2. The surface treatment apparatus of claim 1 further comprising an agitator motor configured to cause the first agitator to rotate.

3. The surface treatment apparatus of claim 1, wherein the drive system is configured to cause the first and second agitator to rotate at different speeds.

4. The surface treatment apparatus of claim 1, wherein the drive system is configured to cause the first and second agitator to rotate in a common direction.

5. The surface treatment apparatus of claim 1, wherein the temporary magnet is an iron pin.

6. The surface treatment apparatus of claim 1, wherein a diameter of the first agitator measures differently from a diameter of the second agitator.

7. The surface treatment apparatus of claim 1, wherein the first magnetic gear is coupled to the first agitator and the second magnetic gear is coupled to the second agitator.

8. The surface treatment apparatus of claim 1 further comprising a body, the first agitator and the second agitator being rotatably coupled to the body and at least one of the first agitator or the second agitator is configured to move along at least one axis.

9. The surface treatment apparatus of claim 8, wherein the first agitator is configured to move along the at least one axis independent of the second agitator.

10. A surface treatment apparatus comprising:
- an upright section; and
- a surface treatment head including:
  - a first agitator;
  - a second agitator; and
  - a drive system having:
    - a first magnetic gear coupled to the first agitator;
    - a second magnetic gear coupled to the second agitator, a rotation of the first magnetic gear causing a corresponding rotation of the second magnetic gear; and
    - a temporary magnet disposed between the first magnetic gear and the second magnetic gear.

11. The surface treatment apparatus of claim 10 further comprising an agitator motor configured to cause the first agitator to rotate.

12. The surface treatment apparatus of claim 10, wherein the drive system is configured to cause the first and second agitator to rotate at different speeds.

13. The surface treatment apparatus of claim 10, wherein the drive system is configured to cause the first and second agitator to rotate in a common direction.

14. The surface treatment apparatus of claim 10, wherein the temporary magnet is an iron pin.

15. The surface treatment apparatus of claim 10, wherein a diameter of the first agitator measures differently from a diameter of the second agitator.

16. The surface treatment apparatus of claim 10, wherein the first agitator is cantilevered.

17. The surface treatment apparatus of claim 10 further comprising a body, the first agitator and the second agitator being rotatably coupled to the body and at least one of the first agitator or the second agitator is configured move along at least one axis.

18. The surface treatment apparatus of claim 17, wherein the first agitator is configured to move along the at least one axis independent of the second agitator.

* * * * *